US006926073B2

(12) United States Patent
Lee

(10) Patent No.: US 6,926,073 B2
(45) Date of Patent: Aug. 9, 2005

(54) SPIRAL HEAT EXCHANGE DEVICE

(75) Inventor: Young-gil Lee, Asan-shi (KR)

(73) Assignee: Winiamando Inc., Asan-shi (KR)

( * ) Notice: Subject to any disclaimer, the term of this patent is extended or adjusted under 35 U.S.C. 154(b) by 0 days.

(21) Appl. No.: 10/674,591

(22) Filed: Sep. 30, 2003

(65) Prior Publication Data

US 2004/0069465 A1 Apr. 15, 2004

(30) Foreign Application Priority Data

Oct. 10, 2002 (KR) ..... 10-2002-0061829

(51) Int. Cl.[7] ..... F28F 9/013
(52) U.S. Cl. ..... 165/121; 165/162; 165/163
(58) Field of Search ..... 165/162, 163

(56) References Cited

U.S. PATENT DOCUMENTS 921,359 A * 5/1909 Carter ..... 122/250 R
981,104 A * 1/1911 Newcomb ..... 122/448.1
1,035,992 A * 8/1912 Molesworth ..... 122/4 R
3,809,061 A * 5/1974 Gerstmann ..... 122/18.4
5,787,722 A * 8/1998 Jenkins ..... 62/305
5,787,974 A 8/1998 Pennington
5,966,943 A 10/1999 Mitchell
6,253,688 B1 7/2001 Lee
6,574,979 B2 * 6/2003 Faqih ..... 62/285
6,651,455 B1 * 11/2003 Yoho, Sr. ..... 62/305

* cited by examiner

*Primary Examiner*—Allen J. Flanigan
(74) *Attorney, Agent, or Firm*—John P. White, Esq.; Cooper & Dunham LLP

(57) ABSTRACT

Disclosed is a spiral heat exchanging device having an improved cooling efficiency in which a plurality of spiral pipes connected to an inlet pipe for introducing a coolant are formed to be spirally wound with a gradually increased diameter toward a blast fan and the coolant is discharged through a discharge pipe so that the wind generated from the blast fan is spread evenly on the spiral pipes.

4 Claims, 7 Drawing Sheets

SPIRAL HEAT EXCHANGE DEVICE

BACKGROUND OF THE INVENTION

1. Field of the Invention

The present invention relates to a heat exchanger of a cooling/heating system, and more particularly to a spiral heat exchange device having improved cooling efficiency in which a plurality of spiral pipes connected to an inlet pipe for introducing a coolant are formed and spirally wound with a gradually increasing diameter toward a blast fan and the coolant is discharged through a discharge pipe so that the wind generated from the blast fan is evenly spread across the spiral pipes.

2. Description of the Related Art

Generally, a cooling device liquefies a coolant by compressing the coolant at high pressure by an outdoor heat exchanger driven by a motor, instantaneously evaporating the coolant by vaporizing the coolant in an indoor heat exchanger while moving the coolant condensed at high pressure into a pipe having a small diameter so as to generate cool air by lowering the temperature, and then discharging the cool air indoors.

The coolant vaporized as heat absorbed by the indoor heat exchanger is moved from a compressor to the outdoor heat exchanger to be condensed and liquefied while emitting heat outside, whereby the cooling device continuously conducts its cooling activity through the above procedure.

On the other hand, recently, cooling devices are being used for both cooling and heating purposes. This cooling/heating device is operated in two ways. The cooling/heat device absorbs outdoor heat and then emits the heat indoors during heating operation, and absorbs indoor heat and emits it outdoors during a cooling operation. Such a cooling device is used in an air conditioner, a refrigerator, or Kimchi refrigerator.

FIG. 1 shows a conventional cooling/heating system, FIG. 2 is a perspective view showing the configuration of a conventional outdoor heat exchanger, FIG. 3 shows the used state of a conventional outdoor heat exchanger, and FIG. 4 shows the conventional outdoor heat exchanger adapted to Kimchi refrigerator.

As for the configuration of the cooling/heating system of FIG. 1, the cooling/heating system includes a compressor 14 for compressing a coolant moving through a pipe conduit at high pressure, an outdoor heat exchanger (or, a condenser) 15 for condensing the coolant compressed in the compressor 14 to emit the hot air outside, an expansion valve 4 for instantaneously expanding the coolant condensed in the outdoor heat exchanger 15, and an indoor heat exchanger (or, an evaporator) 2 for evaporating the coolant expanded in the expansion valve 4 to evaporate the outside heat and decrease the temperature.

As shown in FIG. 2, the conventional outdoor heat exchanger 15 has a coolant transfer pipe 8 for exchanging a hot air through which an inlet pipe 5 for introducing coolant is connected into a discharge pipe 6 for discharging the coolant, being piled in multiple layers to form a hexahedral shape. Between the layers of the coolant transfer pipe 8, a horizontal connector 7 is formed from fine wedded to help the heat discharge of the coolant pipe 8 and horizontally supporting the coolant transfer pipe 8.

In addition, a vertical connector 9 is fixed to connect the horizontal connector 7 vertically.

On the other hand, as shown in FIG. 3 showing a used state of the outdoor heat exchanger 15, the coolant introduced through the inlet pipe 5 moves through the coolant pipe 8 piled up in multiple layers.

At this time, a blast fan 16 installed to a bottom plate 13 using a support stand 18 is rotated by a driving motor 19 so that a cool air is supplied to the coolant pipe 8. Thus, the hot air of the coolant moving through the coolant transfer pipe 8 is discharged outside and then is condensed.

On the other hand, as shown in FIG. 4 showing the outdoor heat exchanger 15 adapted to a Kimchi refrigerator, a door 11 is pivotably mounted to an upper portion of the Kimchi refrigerator using a hinge. Thus, the door 11 is opened or closed when a user puts in or takes out food. In addition, a manipulating panel for inputting various selections such as maturation time for Kimchi taste is attached to an upper front side of the Kimchi refrigerator 10. In the lower portion of the Kimchi refrigerator, a machine room 12 is provided so that various mechanical parts configuring the cooling device are installed.

At this time, on the bottom plate 13 of the machine room 12, the outdoor heat exchanger 15 for cooling and condensing a coolant compressed at high temperature and high pressure, including the compressor 14 for compressing the coolant.

In addition, a blast fan 16 for forcibly transferring a circumferential air according to the operation of the driving motor 19 is installed in front of the outdoor heat exchanger 15 in order to radiate the heat of the outdoor heat exchanger 15.

Thus, the coolant compressed in the compressor 14 is sent to the outdoor heat exchanger 15 through a coolant pipe 17, and the coolant condensed by the blast fan 16 is supplied through the coolant pipe 17 to an evaporator (not shown) wound around a storage container at an upper portion in order to keep the food in the refrigerator fresh.

However, as described above, the conventional outdoor heat exchanger is configured so that the coolant transfer pipe for moving the coolant from the inlet pipe to the discharge pipe is stacked to use a constant amount of space, the horizontal position of this coolant transfer pipe is supported and fixed using the horizontal connector, and this horizontal connector is again fixed using the vertical connector. Thus, the conventional outdoor heat exchanger has problems in that its manufacture cost is higher and manufacturing efficiency is lower due to its complicated structure.

In addition, due to the configuration of the conventional outdoor heat exchanger, the wind generated from the blast fan is not evenly supplied to the entire coolant pipe, thereby sharply decreasing the cooling efficiency. Thus, in order to achieve satisfactory cooling efficiency, it is required to increase the entire area of the outdoor heat exchanger or enlarge the capacity of the blast fan.

SUMMARY OF THE INVENTION

The present invention is designed in consideration of the problems of the prior art, and therefore it is an object of the present invention to provide a spiral heat exchanging device having an improved cooling efficiency in which a plurality of spiral pipes connected to an inlet pipe for introducing a coolant are formed to be spirally wound with a gradually increasing diameter toward a blast fan and the coolant that is discharged through a discharge pipe so that the wind generated from the blast fan evenly contacts the spiral pipes.

In one aspect of the present invention, there is provided a spiral heat exchanging device having an inlet pipe for introducing a coolant and a discharge pipe for condensing and discharging the coolant introduced from the inlet pipe, wherein the spiral heat exchanging device comprises a spiral pipe wound in multiple layers of which a diameter is gradually increased to form a spiral shape as it moves from the inlet pipe to the discharge pipe.

In another aspect of the present invention, there is also provided a spiral heat exchanging device having an inlet pipe for introducing coolant and a discharge pipe for condensing and discharging the coolant introduced from the inlet pipe, which includes an inner spiral pipe wound in a spiral shape so that a diameter is gradually increased from the inlet pipe; and an outer spiral pipe outwardly connected to the inner spiral pipe at a position where the inner spiral pipe has the smallest diameter and wound in a spiral shape at a predetermined spacing with respect to the inner spiral pipe and then connected to the discharge pipe.

In still another aspect of the present invention, there is also provided a spiral heat exchanging device having an inlet pipe for introducing a coolant and a discharge pipe for condensing and discharging the coolant introduced from the inlet pipe, which includes an inner spiral pipe wound in a spiral shape so that the diameter gradually increases from the inlet pipe; an outer spiral pipe outwardly connected to the inner spiral pipe at a position where the inner spiral pipe has the smallest diameter and wound in a spiral shape at a predetermined space from the inner spiral pipe and then connected to the discharge pipe; and a supporting unit for supporting the inner spiral pipe and the outer spiral pipe so as to be fixed to each other.

In further another aspect of the present invention, there is also provided a spiral heat exchanging device having an inlet pipe for introducing coolant and a discharge pipe for condensing and discharging the coolant introduced from the inlet pipe, which includes an inner spiral pipe wound in a spiral shape so that the diameter gradually increases from the inlet pipe; an outer spiral pipe outwardly connected to the inner spiral pipe at a position where the inner spiral pipe has the smallest diameter and wound in a spiral shape at a predetermined spacing with respect to the inner spiral pipe and then connected to the discharge pipe; a supporting unit for supporting the inner spiral pipe and the outer spiral pipe so as to be fixed to each other; and a blast unit installed to the inner spiral pipe and the outer spiral pipe at a portion where the inner and outer spiral pipes have the greatest diameter in order to blast air to a center portion of the pipes for cooling.

In another aspect of the present invention, there is also provided a Kimchi refrigerator having an machine room in a lower portion thereof, the machine room having, on a base panel, a compressor for compressing the coolant, an outdoor heat exchanger for condensing the compressed coolant and a cooling fan for blasting an air to the outer heat exchanger for releasing heat, wherein the outer heat exchanger includes an inlet pipe connected to a coolant pipe through which the coolant compressed in the compressor passes; a spiral pipe connected to an end of the inlet pipe, the spiral pipe being formed in multiple layers and wound to have a gradually increasing diameter in one direction; and a discharge pipe having one end connected to an end of the spiral pipe and the other end connected to the coolant pipe moving to an evaporator.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Figure 1:
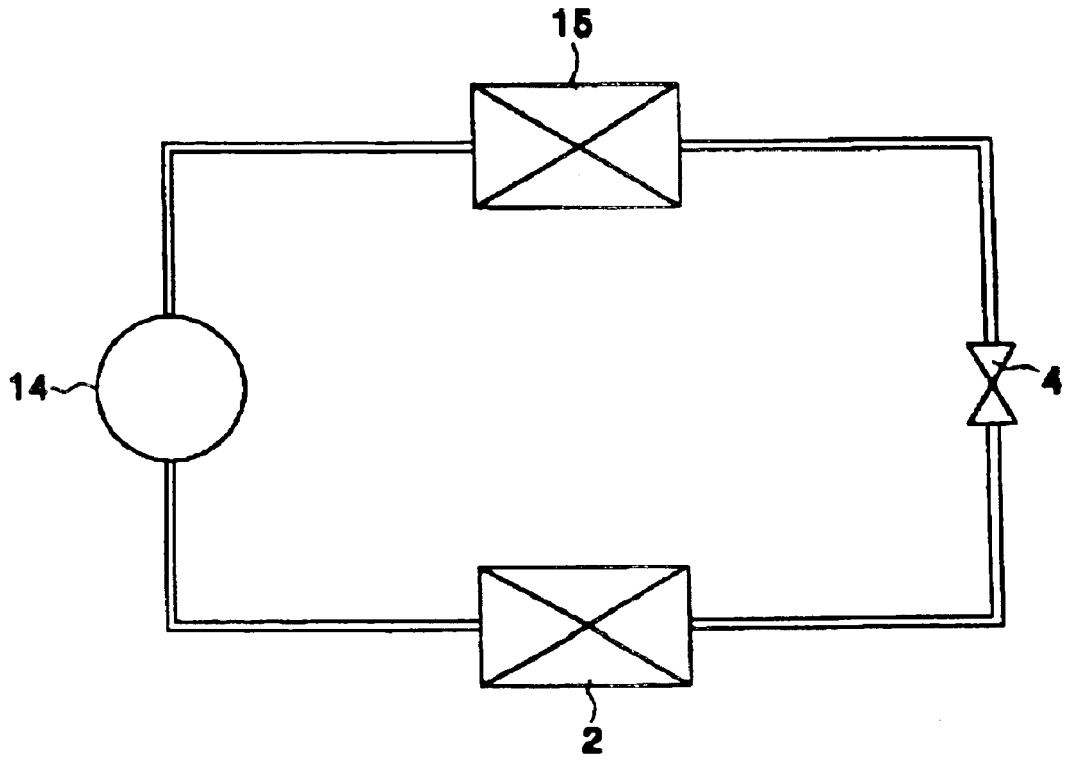
FIG. 1 PRIOR ART
FIG. 1 shows a conventional cooling/heating system.
Figure 2:
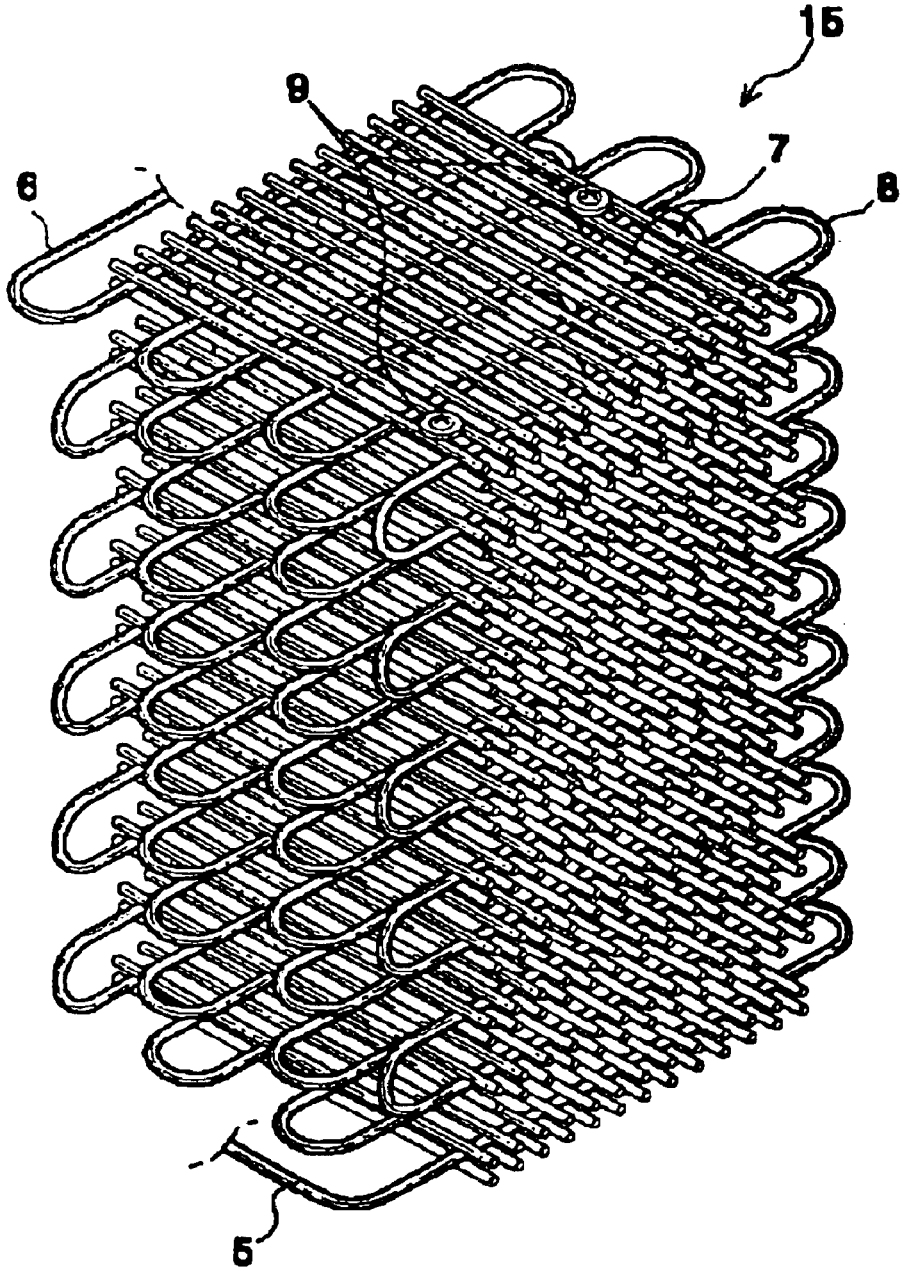
FIG. 2 PRIOR ART
FIG. 2 is a perspective view showing a configuration of the conventional outdoor heat exchanger.
Figure 3:
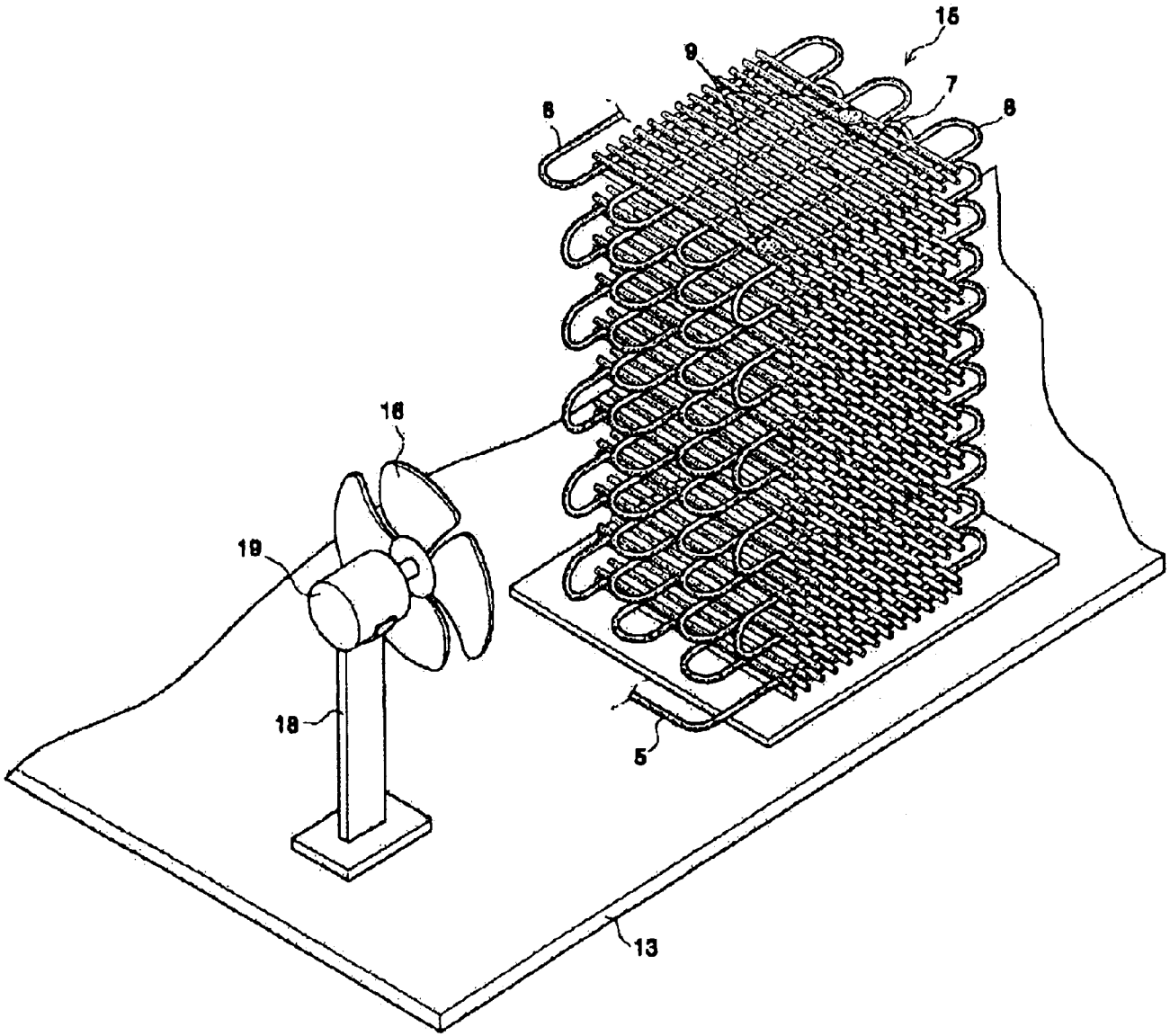
FIG. 3 PRIOR ART
FIG. 3 shows a used state of the conventional outdoor heat exchanger.
Figure 4:
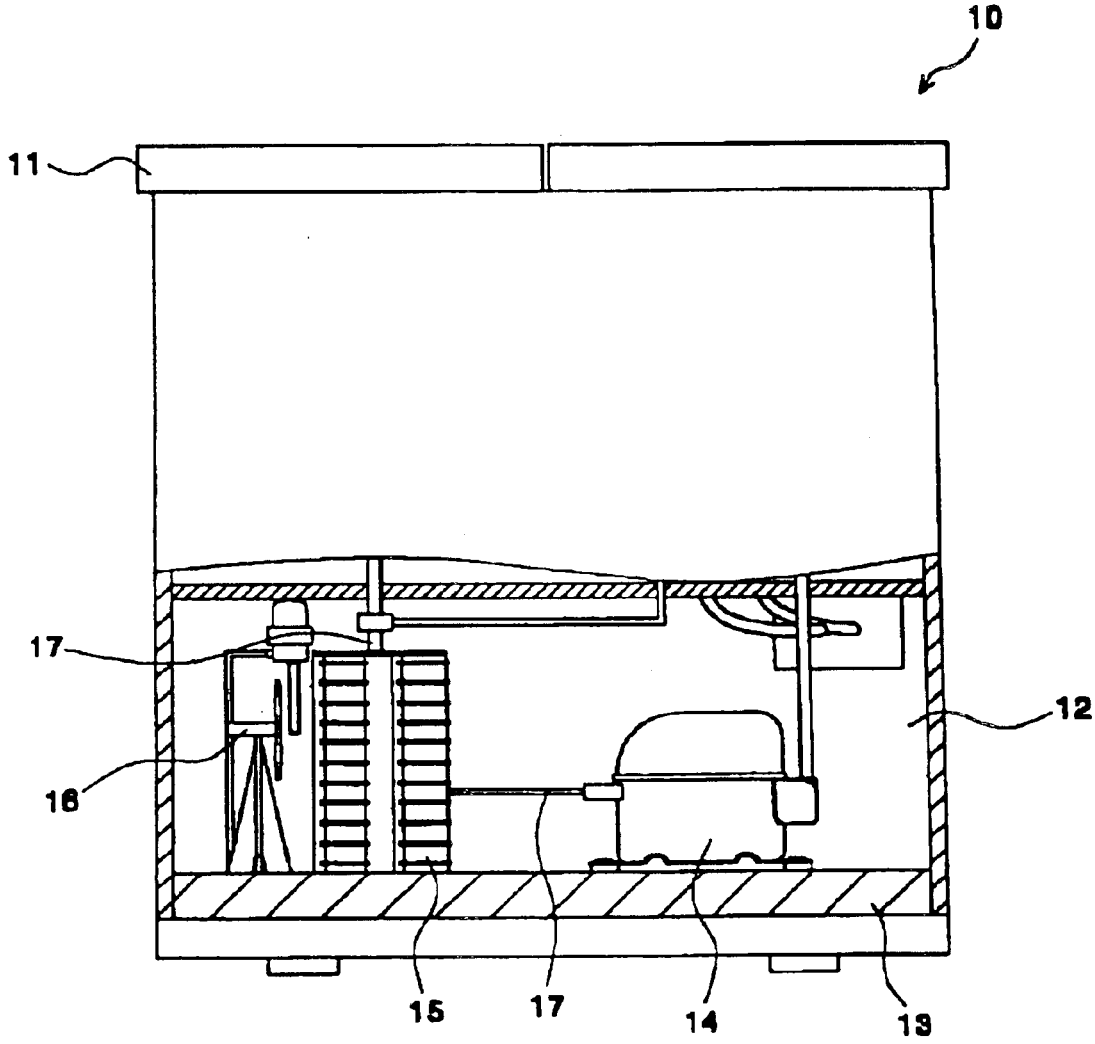
FIG. 4 PRIOR ART
FIG. 4 shows the conventional outdoor heat exchanger adapted to a Kimchi refrigerator.

Hereinafter, preferred embodiments of the present invention will be described in more detail referring to the drawings.

In addition, the following embodiments are just for illustration only, not intended to limit the scope of the invention, and the identical component to the conventional art uses the identical reference numerals and name.

Figure 5:
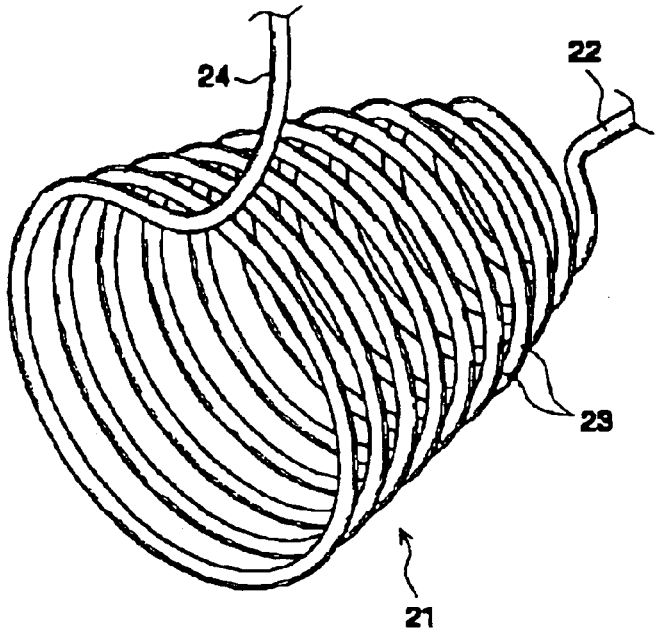
FIG. 5 is a perspective view showing the spiral heat exchanging device according to a first embodiment of the present invention.
Figure 6:
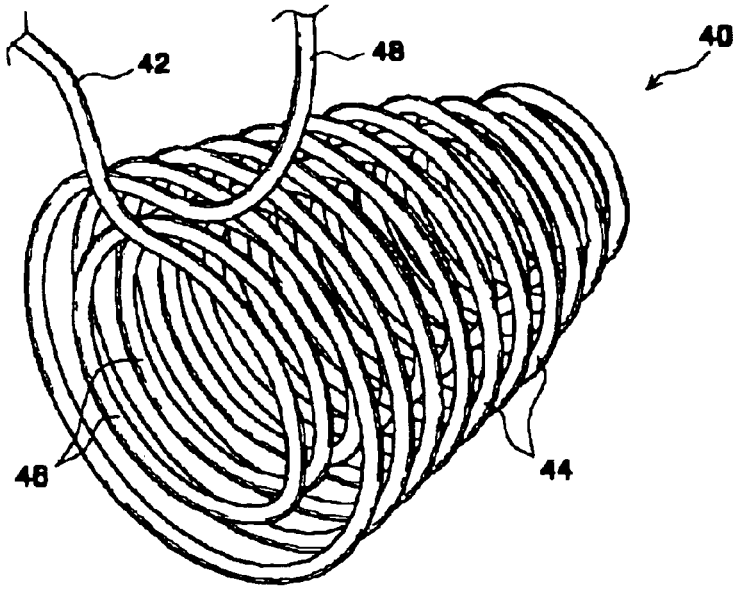
FIG. 6 is a perspective view showing the spiral heat exchanging device according to a second embodiment of the present invention.
Figure 7:
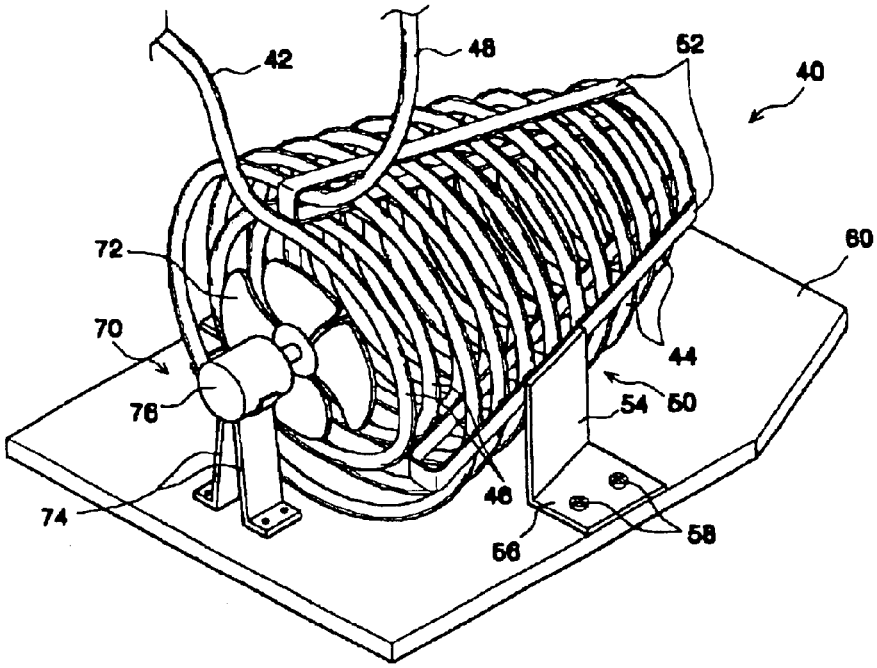
FIG. 7 shows an installation state of the spiral heat exchanging device according to the second embodiment of the present invention.
Figure 8:
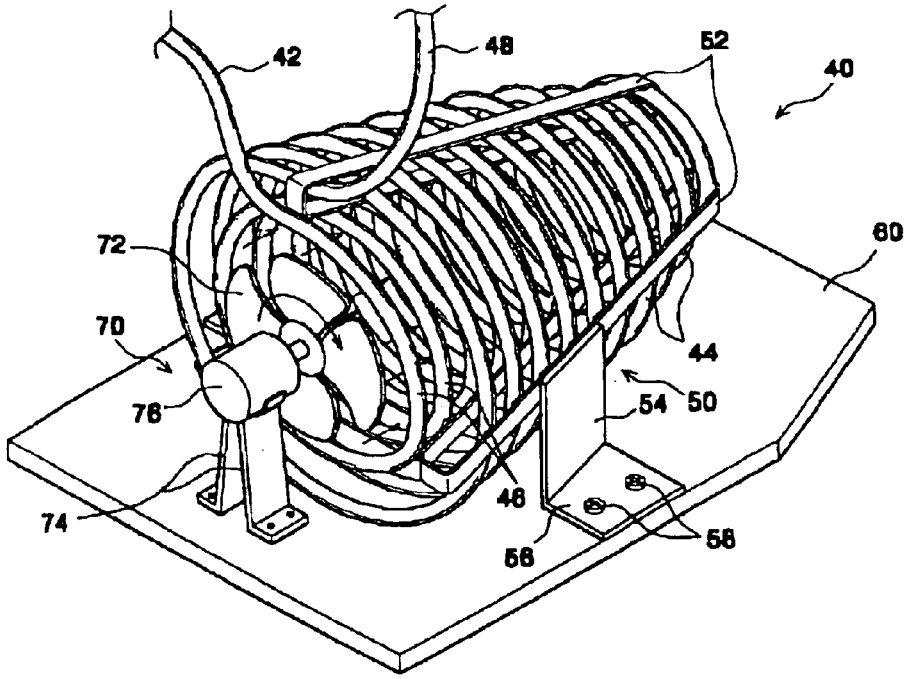
FIG. 8 shows a used state of the spiral heat exchanging device according to the second embodiment of the present invention.
Figure 9:
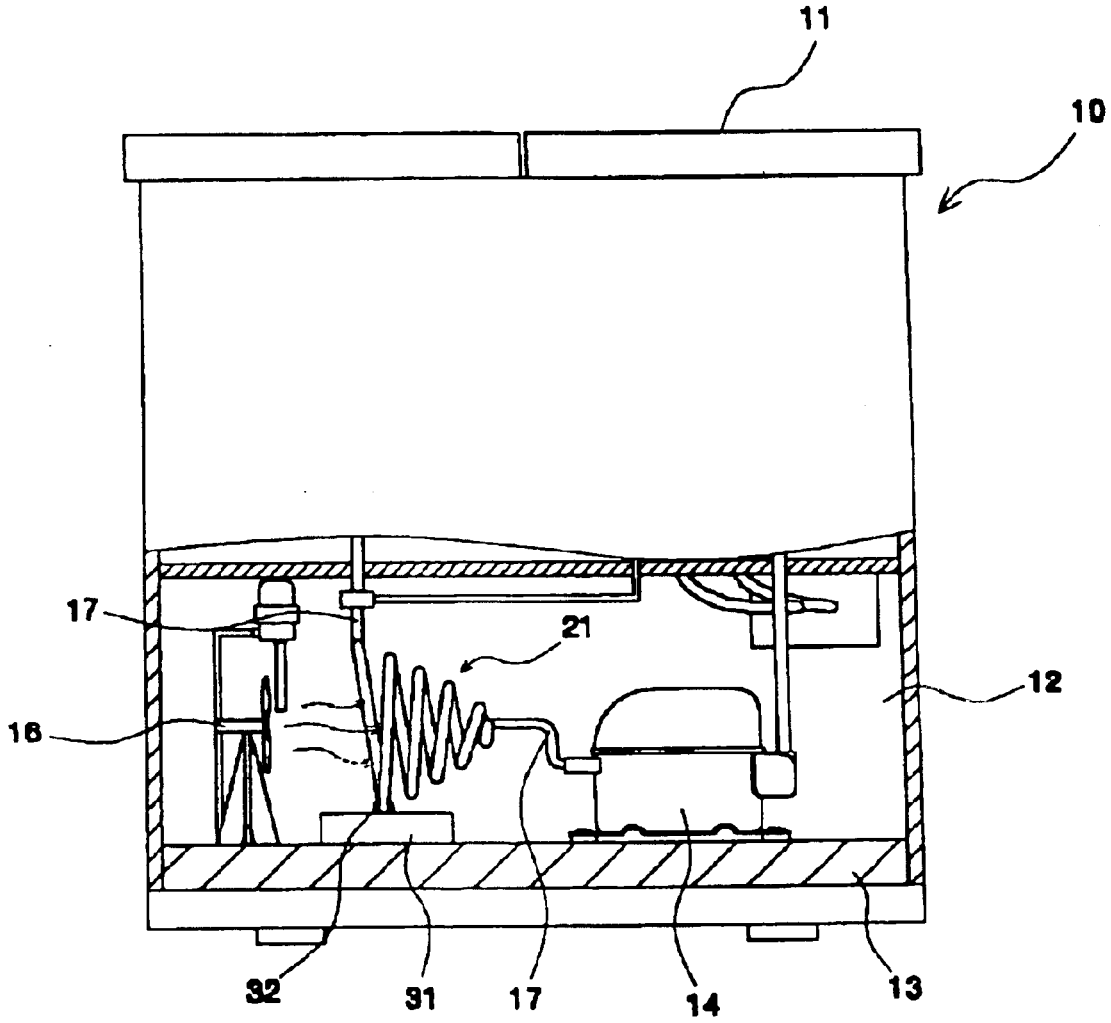
FIG. 9 shows a used state of the spiral heat exchanging device according to the first embodiment of the present invention when adapted to a Kimchi refrigerator.

FIG. 5 is a perspective view showing the spiral heat exchanging device according to a first embodiment of the present invention, FIG. 6 is a perspective view showing the spiral heat exchanging device according to a second embodiment of the present invention, FIG. 7 shows an installation state of the spiral heat exchanging device according to the second embodiment of the present invention, FIG. 8 shows a used state of the spiral heat exchanging device according to the second embodiment of the present invention, and FIG. 9 shows a used state of the spiral heat exchanging device according to the first embodiment of the present invention when adapted to a Kimchi refrigerator.

The spiral heat exchanging device 21 according to the first embodiment of the present invention includes an inlet pipe 22 for introducing a coolant and a discharge pipe 24 for condensing and discharging the coolant introduced from the inlet pipe 22. The spiral heat exchanging device 21 also includes a spiral pipe 23 being wound in multiple layers of which a diameter gradually increases to form a spiral shape as moving from the inlet pipe 22 to the discharge pipe 24.

In addition, the spiral pipe is preferably wound an odd number of times so that the inlet pipe 22 is opposite the discharge pipe 24.

Or else, the spiral pipe may also be wound an even number of times so that the inlet pipe 22 is in the same position as the discharge pipe 24.

The spiral heat exchanging device 40 according to the second embodiment of the present invention includes an inlet pipe 42 for introducing coolant and a discharge pipe 48 for condensing and discharging the coolant introduced from the inlet pipe 42. The spiral heat exchanging device 40 also includes an inner spiral pipe 46 wound in a spiral shape so that the diameter gradually increases from the inlet pipe 42; and an outer spiral pipe 44 outwardly connected to the inner spiral pipe 46 at a position where the inner spiral pipe 46 has the smallest diameter and wound in a spiral shape at a predetermined space with respect to the inner spiral pipe 46 and then connected to the discharge pipe 48.

In addition, the spacing between the inner spiral pipe 46 and the outer spiral pipe 44 gradually narrows as it moves from a position having a large diameter to a small one.

The spiral heat exchanging device 40 according to the present invention having an inlet pipe 42 for introducing a coolant and a discharge pipe 48 for condensing and discharging the coolant introduced from the inlet pipe 42 may also include an inner spiral pipe 46 wound in a spiral shape so that the diameter gradually increases from the inlet pipe 42; an outer spiral pipe 44 outwardly connected to the inner spiral pipe 46 at a position where the inner spiral pipe 46 has the smallest diameter and wound in a spiral shape at a predetermined spacing with respect to the inner spiral pipe 46 and then connected to the discharge pipe 48; and a supporting unit 50 for supporting the inner spiral pipe 46 and the outer spiral pipe 44 so as to be fixed to each other.

The supporting unit 50 may include a plurality of fixing plates 52 fixed to inner and outer sides of the inner spiral pipe 46 and the outer spiral pipe 44 respectively at a regular space, a support stand 54 fixed to a side of the fixing plate 52 and extended downward for supporting the inner spiral pipe 46 and the outer spiral pipe 44, a bent portion 56 bent horizontally from an end of the support stand 54 and an engaging member 58 for engaging the bent portion 56 to a bottom plate 60.

At this time, the engaging member is preferably a screw.

In addition, the spiral heat exchanging device according to the present invention having an inlet pipe 42 for introducing a coolant and a discharge pipe 48 for condensing and discharging the coolant introduced from the inlet pipe 42 may also include an inner spiral pipe 46 wound in a spiral shape so that the diameter gradually increases from the inlet pipe 42; an outer spiral pipe 44 outwardly connected to the inner spiral pipe 46 at a position where the inner spiral pipe 46 has the smallest diameter and wound in a spiral shape at a predetermined space with respect to the inner spiral pipe 46 and then connected to the discharge pipe 48; a supporting unit 50 for supporting the inner spiral pipe 46 and the outer spiral pipe 44 so as to be fixed to each other; and a blast unit 70 installed to the inner spiral pipe 46 and the outer spiral pipe 44 at a portion where the inner and outer spiral pipes 46 and 44 have the largest diameter in order to blast air to the center of the pipes for cooling.

Preferably, the blast unit includes a fan support 74 supported to the bottom plate 60, a driving motor 76 supported by the fan support 74 for generating a driving force, and a blast fan 72 coupled to a rotary shaft of the driving motor 76 for blasting air toward the inner spiral pipe 46 and the outer spiral pipe 44.

The spiral heat exchanging device 21 according to the first embodiment of the invention may be adapted to a Kimchi refrigerator 10. In this case, the Kimchi refrigerator 10 has an machine room 12 in a lower portion thereof, the machine room 12 having, on a base panel 13, a compressor 14 for compressing a coolant, an outdoor heat exchanger 21 for condensing the compressed coolant and a cooling fan 16 for blasting an air to the outer heat exchanger 21 for releasing heat. The outer heat exchanger 21 includes an inlet pipe 22 connected to a coolant pipe 17 through which the coolant compressed in the compressor 14 passes; a spiral pipe 23 connected to an end of the inlet pipe 22, the spiral pipe being 23 formed in multiple layers and wound to have a gradually increasing diameter ; and a discharge pipe 24 having one end connected to an end of the spiral pipe 23 and the other end connected to the coolant pipe 17 moving to an evaporator (not shown).

In addition, the outdoor heat exchanger 21 has at an upper portion, a fitting protrusion 32 to which the spiral pipe 23 is fitted, and a lower portion of the outdoor heat exchanger 21 is fixed by a fixing bracket 31 fixed to the base panel 13.

Now, the operation and effects of the present invention will be described with reference to the accompanying drawings.

In the first embodiment of the present invention, as shown in FIG. 5, the coolant introduced to the inlet pipe 22 is discharged to the discharge pipe 24 through the spiral pipe 23 having a gradually increasing diameter while cooling the coolant.

As shown in FIG. 9, a used state of the spiral heat exchanging device will be described in which the configuration of the first embodiment is adapted to the Kimchi refrigerator.

A bottom portion of the spiral pipe 23 of the outdoor heat exchanger 21 is fitted into the fitting protrusion 32 of the fixing bracket 31 so as to be stably mounted in the machine room 12.

The coolant then passes through the inlet pipe 22 and the wound spiral pipe 23 and is then discharged through the discharge pipe 24 to the coolant pipe 17. At this time, the cooling fan 16 provides an air volume to the outdoor heat exchanger 21. This air volume is evenly transferred owing to the shape of the outdoor heat exchanger 21, thereby creating a condensing effect.

In addition, due to the improved condensing effect using the shape of the outdoor heat exchanger 21, it is possible to reduce the overall area of the outdoor heat exchanger 21 to thus decrease the size thereof, so the size of the machine room 12 is also reduced. Thus, it is possible to reduce the overall size of the Kimchi refrigerator 10 or maximize the storage capacity thereof.

Now, the operation and effect of the spiral heat exchanging device 40 according to the second embodiment of the present invention will be described with reference to FIGS. 6 to 8.

First, in order to manufacture the spiral heat exchanging device 40 according to the second embodiment of the present invention, the inner spiral pipe 46 connected from the inlet pipe 42 is spirally wound a predetermined number of times to have a gradually decreasing diameter.

In addition, the inner spiral pipe 46 is also wound outwardly at an end where the inner spiral pipe 46 has the smallest diameter, and the pipe is then spirally wound again at a predetermined spacing with respect to the inner spiral pipe 46 to form the outer spiral pipe 44, which is then connected to the discharge pipe 48.

At this time, though it is shown that the inner spiral pipe 46 and the outer spiral pipe 44 are respectively wound in one layer, the inner and outer spiral pipes 46 and 44 may be wound in plural layers in order to increase the heat exchanging area.

If the inner spiral pipe 46 and the outer spiral pipe 44 are wound an odd number of times, the inlet pipe 42 and the discharge pipe 48 are positioned in the opposite direction. On the contrary, if the inner spiral pipe 46 and the outer spiral pipe 44 are wound an even number of times, the inlet pipe 42 and the discharge pipe 48 are positioned in the same direction.

In addition, the spacing between the inner spiral pipe 46 and the outer spiral pipe 44 is preferably gradually narrowed from a portion where the diameter is bigger to a portion where the diameter is smaller. This is helpful for efficient movement of the coolant.

On the other hand, a plurality of fixing plates 52 are contacted and fixed as the supporting unit 50 to the inner or outer sides of the outer spiral pipe 44 and inner spiral pipe 46 of the spiral heat exchanging device 40 by welding.

In this embodiment of the present invention, it is shown that three fixing plates 52 are used.

In addition, the support stand 54 is fixed to both sides of two fixing plates 52 by a welding means or other engaging unit. At the end of the support stand 54, the bent portion 56 is formed and engaged to the bottom plate 60 using an engaging member 58 such as a screw or a bolt.

Then, at a portion with a large diameter of the inner spiral pipe 46 and the outer spiral pipe 44 of the spiral heat exchanging device 40, the fan support 74 of the blast unit 70 is engaged to the bottom plate 60.

The driving motor 76 is fixed to the fan support 74, and thereafter the blast fan 72 is fixed to the rotary shaft of the driving motor 76.

In the assembled state as described above, if the coolant flows in to the inlet pipe 42, the coolant moves through the inner spiral pipe 46 from the portion having a big diameter to the portion having a small diameter, then moves through the outer spiral pipe 44 from the portion having a small diameter to the portion having a big diameter, and then is discharged through the discharge pipe 48.

On the other hand, as shown in FIG. 8, while the coolant moves through the inner spiral pipe 46 and the outer spiral pipe 44, the driving motor 76 is operated to rotate the blast fan 72. The wind generated by the rotating blast fan 72 helps to cool the coolant while passing through a center portion of the inner spiral pipe 46 and the outer spiral pipe 44.

Looking at a view of the blast fan 72, the inner spiral pipe 46 and the outer spiral pipe 44 are installed, with the wind being exposed. Thus, the cooling efficiency of the spiral heat exchanging device may be dramatically increased as compared to conventional devises.

In addition, the spiral heat exchanging device of the present invention may be adapted to all kinds of heat exchangers of the cooling/heating system such as an air conditioner and a refrigerator, not limited to the Kimchi refrigerator.

As described above, when using the spiral heat exchanging device according to the present invention, the coolant is discharged through the discharge pipe after passing through the spiral pipe connected to the inlet pipe for introducing a coolant and spirally wound toward the blast fan to have a gradually increasing diameter. Thus, the wind generated from the blast fan is spread evenly across the entire spiral pipe, thereby increasing the cooling efficiency thereof.

In addition, since the spiral pipe of the spiral heat exchanging device is wound in a coil, it is easy to manufacture and the manufacture cost is lowered owing to the reduced length of the pipe.

What is claimed is:

1. A heat exchanging device having an inlet pipe for introducing a coolant and a discharge pipe for discharging the coolant introduced from the inlet pipe, the heat exchange device comprising:

an inner spiral pipe wound in a spiral shape so that the diameter gradually decreases from the inlet pipe;

an outer spiral pipe outwardly connected to the inner spiral pipe at a position where the inner spiral pipe has the smallest diameter and wound in a spiral shape at a predetermined space from the inner spiral pipe and then connected to the discharge pipe; and a supporting unit for supporting the inner spiral pipe and the outer spiral pipe so as to be fixed to each other, wherein the supporting unit comprises a plurality of fixing plates to maintain a regular space between the inner spiral pipe and the outer spiral pipe; a support stand fixed to side of the fixing plate and extended downward for supporting the inner spiral pipe and the outer spiral pipe; a bent portion bent horizontally from an end of the support stand; and an engaging member for engaging the bent portion to a bottom plate.

2. The heat exchanging device according to claim 1, wherein the engaging member is a screw.

3. A heat exchanging device having an inlet pipe for introducing a coolant and a discharge pipe for condensing and discharging the coolant introduced from the inlet pipe, the heat exchange device comprising:

an inner spiral pipe wound in a spiral shape so that the diameter gradually decreases from the inlet pipe;

an outer spiral pipe outwardly connected to the inner spiral pipe at a position where the inner spiral pipe has the smallest diameter and wound in a spiral shape at a predetermined spacing with respect to the inner spiral pipe and then connected to the discharge pipe;

a supporting unit for supporting the inner spiral pipe and the outer spiral pipe so as to be fixed to each other; and a blast unit for blasting air to the center of the pipes for cooling, wherein the blast unit comprises a fan support supported to a bottom plate; a driving motor supported by the fan support for generating a driving force; and a blast fan coupled to a rotary shaft of the driving motor for blasting an air toward the inner spiral pipe and the outer spiral pipe.

4. The heat exchanging device according to claims 3, wherein the blast unit is installed to the inner spiral pipe and the outer spiral pipe at a portion where the inner and outer spiral pipes have the greatest diameter.

* * * * *